United States Patent [19]

Hudgins

[11] Patent Number: 4,989,834

[45] Date of Patent: Feb. 5, 1991

[54] FENCE COMBINATION

[76] Inventor: Hal D. Hudgins, 5423 Spring Creek Dr., Tyler, Tex. 75703

[21] Appl. No.: 555,312

[22] Filed: Jul. 20, 1990

[51] Int. Cl.[5] ..... E04H 17/00

[52] U.S. Cl. ..... 256/1; 256/59; 256/24

[58] Field of Search ..... 256/1, 24, 59, 65

[56] References Cited

U.S. PATENT DOCUMENTS

| | | | |
|---|---|---|---|
| 3,195,863 | 7/1965 | Korecky et al. . | |
| 3,945,747 | 3/1976 | Cruz . | |
| 4,352,485 | 10/1982 | Basey | 256/65 |
| 4,478,391 | 10/1984 | Kovach . | |
| 4,497,472 | 2/1985 | Johnson . | |
| 4,515,349 | 5/1985 | Groves . | |
| 4,548,388 | 10/1985 | Cobler . | |
| 4,690,382 | 9/1987 | Koperdak . | |
| 4,907,783 | 3/1990 | Fisk | 256/1 X |

*Primary Examiner*—Andrew V. Kundrat

*Attorney, Agent, or Firm*—James C. Fails; Arthur F. Zobal; Geoffrey A. Mantooth

[57] ABSTRACT

A fence combination including a fence protector disposed along a line of the fence and adapted to hold fence material off the ground characterized by a plurality of sections abutting in end-to-end engagement, with each section having a fence receiving slot, a shoulder defined by engagement of the fence receiving slot and a lesser dimensioned drain slot therebelow; and a plurality of fastening means adapted to hold the sections aligned along the line of the fence. Also disclosed is a preferred embodiment which each section has a plurality of drain passageways extending from the bottom of the drain slot to the bottom of the section; wherein clips are provided for holding the ends of the sections in alignment by engaging these respective drain passageways at the ends of each sections.

3 Claims, 2 Drawing Sheets

FENCE COMBINATION

FIELD OF THE INVENTION

This invention relates to fence combinations. More particularly, this invention relates to combinations in which a fence protector, or support, is employed to alleviate problems with damage to the base of a fence.

BACKGROUND OF THE INVENTION

Problems with fence damage has been long known. The prior art is replete with different approaches to protecting either vegetation, the ground beneath the fence, or the fence, per se. These have run the gambit from protecting against moisture invasion, as by using a Michigan Cedar or California Redwood as the material of which the fence is made, to employing upstanding bases; such as, of concrete or the like to keep moisture from invading the fence.

The enclosed Information Disclosure Statement discloses patents that were turned up by a preexamination search made in the United States Patent and Trademark Office. Among these, U.S. Pat. No. 4,478,391 describes the problems with protecting a fence and recites earlier issued patents on different approaches such as fence borders, skirts for fence posts, roll form grass guards, vegetation barriers or the like. The prior art has been deficient in two main aspects. Firstly, it failed to keep the fence elevated off the ground. This is important particularly for wooden fences or the like. It is important that the fence protector serves as a base, keeps the fence elevated and keeps deleterious liquids from adversely invading at least the bottom of the fence material. Secondly, the fence protector, or protector for the vegetation may be made of the same or different material compared to the fence.

SUMMARY OF THE INVENTION

It is therefor an object of this invention to provide apparatus as part of a combination for protecting both the fence and vegetation adjacent the fence; yet, provide one of the foregoing features delineated as desirable and are not heretofore provided by the prior art.

It is also an object of this invention to provide apparatus in a combination for a fence that provides substantially all of the objects delineated hereinbefore as desirable and not heretofore provided.

These and other objects of the invention will be made clear from the following description particularly when read in the light of accompanying drawings.

In accordance with one embodiment of this invention there is provided a fence combination that includes a fence having upwardly extending substantially planar construction; and a protector characterized by a plurality of sections abutting an end-to-end engagement and supporting the fence, each section having a substantially planar fence receiving slot and a lower drain slot intersecting the fence receiving slot and forming shoulders therewith, the shoulders supporting the fence. There are also shown a plurality of fastening means at each end of each section for maintaining the sections aligned along the fence line.

In another aspect of the invention there is shown the protector for the fence, at least along its base and having the respective plurality of sections and the fastening means.

In preferred embodiments, the drain slot of each section also has a plurality of drain passageways for draining off any liquid, such as rain, that tends to accumulate in the drain slot; and the fastener means for respective fastened ends comprises respective clip means that engage each end drain passageway of each section to maintain the alignment of the sections supporting the fence.

DESCRIPTIONS OF THE DRAWINGS

FIG. 1*a* is a partial front elevational view showing at least a portion of one section of a fence and base, or protector, therefor.

FIG. 1*b* is a top view of the base for the fence in accordance with FIG. 1*a*.

FIG. 1*c* is an end view of the base for the fence together with a portion of the view of the fence of FIG. 1*a*.

DESCRIPTION OF PREFERRED EMBODIMENTS

It should be borne in mind that this invention may have a multiplicity of uses. It has been found particularly useful in the support of a fence such as a wooden plank fence and it is in that technology that it will be described hereinafter.

Figure 1A:
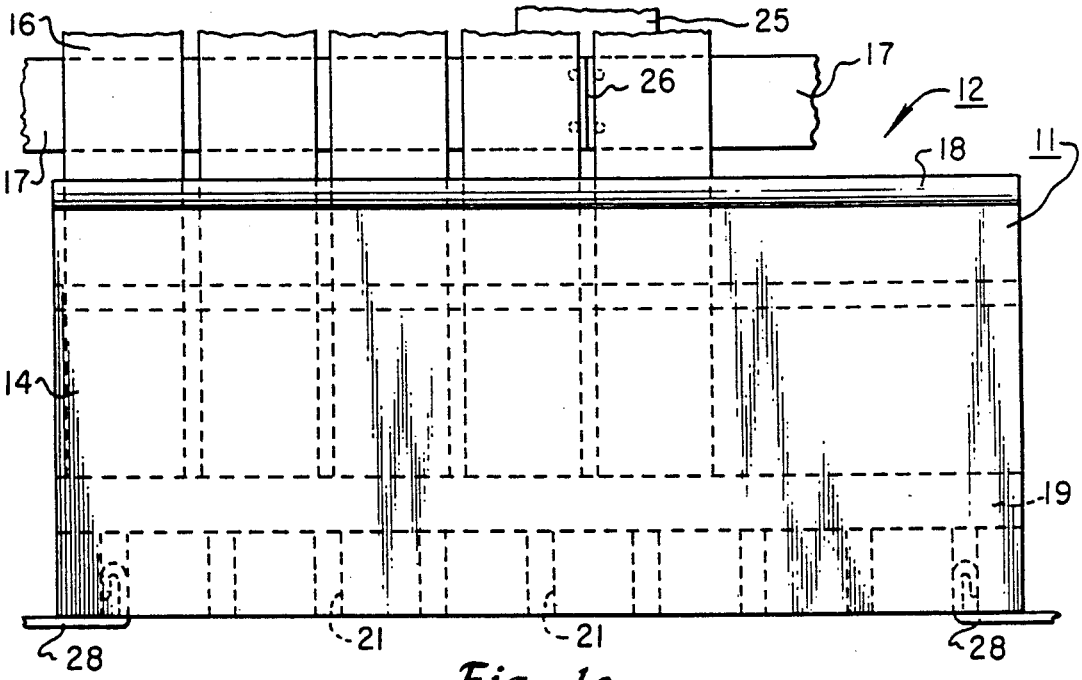
Figure 1B:
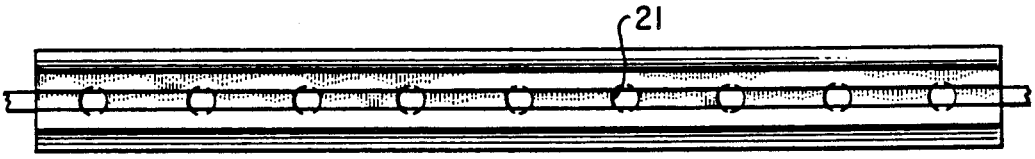
Figure 1C:
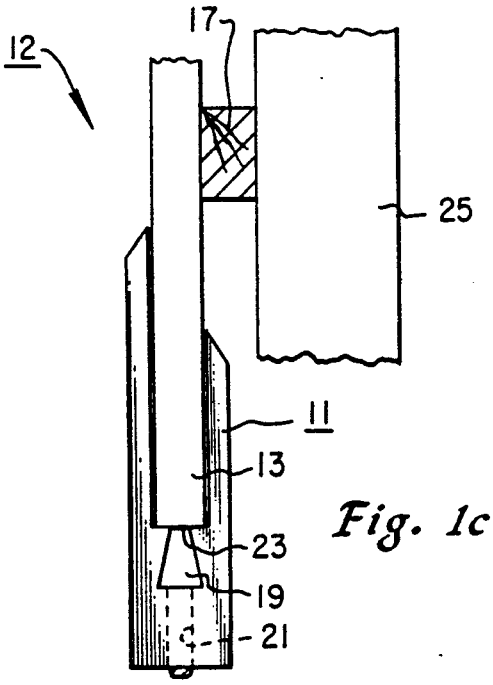

Referring to the figures and particularly FIG. 1*a*, the fence protector 11 supports the fence 12 as can be seen in FIGS. 1*a* and 1*c*. Specifically, the fence protector 11 has a plurality of sections, or sectors, 14 in end-to-end abutting relationship, or engagement. Each of the sections has an upper, substantially planar fence receiving slot 13, seen more clearly in FIG. 2, for receiving fence 12, FIG. 1*c*, or the like. The sectors may have substantially equal length sides 15 defining each slot 13 if desired. On the other hand, if desired, the outside edge, such as 15*a*, FIG. 2, can be shortened with respect to the inside edge 15*b* if the outside edge does not receive punishment from an edger or the like as does the inside edge. It is to be borne in mind that these edges 15 serve to protect the fence 16 from problems associated with cutting of the grass, edging, and the like.

As is recognized, each section of the fence is a substantially planar section and may be formed of any of the usual materials of construction such as wire in a chain link fence, wood, as in a wooden fence, or the like. Illustrated is a part of a section of fence in which wooden staves are fastened to a respective holder such as 2"×4" holder 17. The holder 17 is then fastened as by nails or screws to respective posts 25. The fence is received in the fence receiving slot 13 of each section 11. In this way, the fence is held off the ground. As will be apparent, this is particularly important with a wooden fence.

Figure 2:
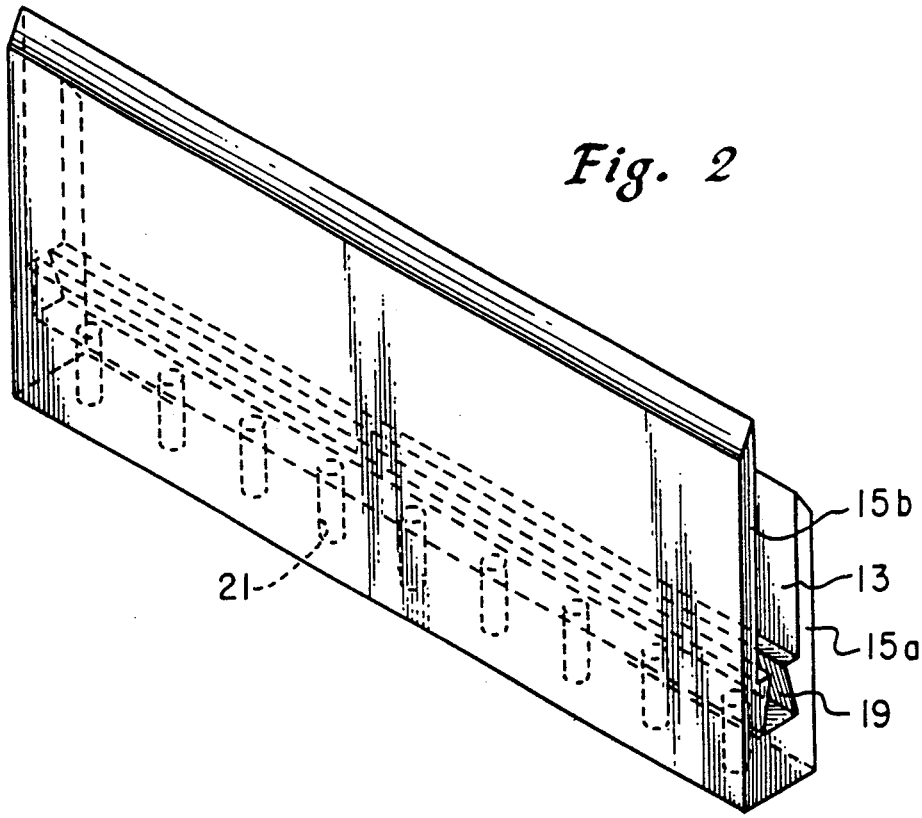
FIG. 2 is an isometric view of a base fence protector section as illustrated in FIG. 1*a*.

In each section 14, for a wooden fence maintained off the ground, a drain slot 19, FIG. 2, serves to drain the liquid such as rain which might run down the fence or the like and be received in the slots 13 and 19. The drain slot 19 has an intersection with the fence receiving slot 13 but is a lesser dimension where the intersection occurs so as to form shoulders 23 that will support the fence 16. The respective nails, screws or the like, given the numeral 26, can be seen in FIG. 1*a*, and hold the holder 17 to a respective post 25.

Figure 3:
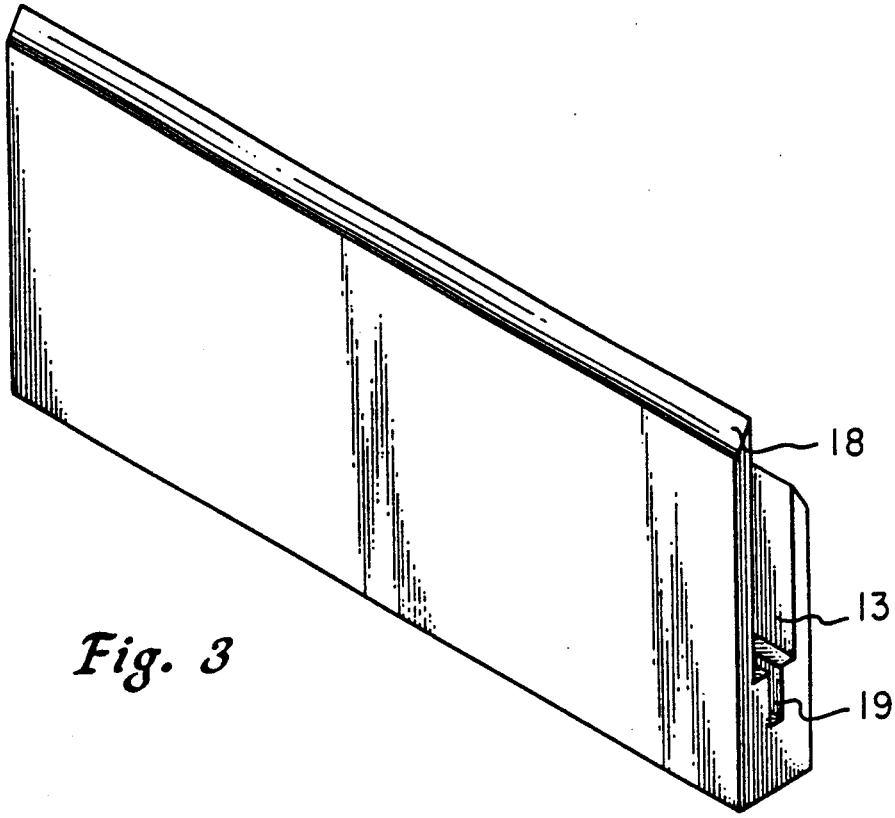
FIG. 3 is an isometric view of another embodiment of this invention showing a base fence protector with a substantially planar slot of rectangular cross-sectional shape.

If desired, the drain slot 19 may be substantially rectangular in cross-sectional shape as shown in FIG. 3, instead of trapezoidal shape as shown in FIG. 1*c*, or 2.

As illustrated, each of the sections 14 has respective outwardly and downwardly extending sides 18 that serve to drain water exteriorly of the fence, instead of having it drain down the fence and into the bottom drain slot 19.

Just as the fence may be formed of any material, from galvanized wire as is used in chain link fencing to wood such as conventionally used with staves affixed to support holder and posts, so may the fence protector be made of any material desired. Specifically, the fence protector 17 may be formed of a metal such as aluminum or steel; or it may be formed of plastic or other moisture impervious material. It is preferred that it not be formed of wood although wooden materials can be employed if desired. It has been found that plastic is particularly useful since it is impervious to water and since it can be extruded for forming economical sections.

A plurality of fastening means in the forms of clips 28, FIG. 1*a*, can be employed at each end of each of the sections for holding the sections aligned. Preferably, suitable apertures are formed for receiving the ends of the clips 28. The apertures can be in the form of drain passageways 21 if desired. These drain passageways are formed in the bottom of the drainage trench to facilitate draining water out the bottom of each of the sections instead of having to rely upon the water running longitudinally of each of the sections.

Each of the sections is preferably in the range of from 1½ to 2 feet in length so that they can be easily handled and installed. Preferably, the shoulder 23 is at least 2½ inches off the ground to hold the bottom of the fence off the ground and prevent water seeping thereinto.

Of course, dimensions can be changed as desired for the particular installation.

The fence in FIG. 1*a* is shown only partially and is omitted from FIG. 1*b* in order that the drain passageways 21 can be seen more clearly.

Other means of fastening the sections together can be employed if desired. Similarly, the illustrated lengths for the sections is not critical to the performance of the job for the sections and even longer sections can be employed if desired.

Each of the sections are substantially identical in cross-sectional configuration and each has a main body portion with respective slots performing their functions as delineated hereinbefore. If different type of sections are employed, they should be made compatible if they are to be employed along a common fence line. It is preferable that the material of which the sections are made be resistant to both the vegetation and to any herbicide that may be placed along the line of the fence, as well as drain off water or the like from the fence.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. A base fence protector disposed along a line of a fence and adapted to hold fence material off the ground comprising:

a. a plurality of sections abutting in end-to-end engagement; each said section having an upper substantially planar fence receiving slot defined by upstanding edges along respective sides; each said fence receiving slot being disposed in a plane; and a lower drain slot intersecting said fence receiving slot and disposed in a plane parallel with the plane of the fence receiving slot, said lower drain slot intersecting said fence receiving slot and having lesser lateral dimensions so as to define fence receiving shoulders at the intersection with the fence receiving slot; each said section having a plurality of liquid drain passageways for draining off any liquid that tends to accumulate in said liquid drain slot; said liquid drain passageways extending from the bottom of said liquid drain slot to the bottom of said fence protector; and b. a plurality of fastening means adapted to engage respective ends drain passageways for holding said sections together and aligned along the line of the fence.

2. A fence combination, including:

a. a fence having an upwardly extending, substantially planar structure;

b. a plurality of fence protector sections abutting in end-to-end engagement along the line of the fence; each said section having an upper substantially planar fence receiving slot defined by upstanding edges along respective sides; each said fence receiving slot being disposed in a plane; and a lower drain slot intersecting said fence receiving slot and disposed in a plane parallel with the plane of the fence receiving slot, said lower drain slot intersecting to said fence receiving slot and having lesser lateral dimensions so as to define fence receiving shoulders at the intersection with the fence receiving slot; and c. a plurality of fastening means adapted to engage respective ends of each said section for holding said sections together and aligned along the line of the fence.

3. The combination of claim 2 wherein said plurality of sections each have a plurality of drain passageways extending from the bottom of said drain slot to the bottom of each said section.

* * * * *